US008044753B2

(12) United States Patent
Azuma et al.

(10) Patent No.: US 8,044,753 B2
(45) Date of Patent: Oct. 25, 2011

(54) COMMON-MODE CHOKE COIL

(75) Inventors: Takahiro Azuma, Yokohama (JP); Tetsuya Morinaga, Otsu (JP); Takahiro Aoki, Moriyama (JP); Yoshie Nishikawa, Tsim Sha Tsui (HK); Shinya Hirai, Kusatsu (JP); Yoshimasa Goto, Sagamihara (JP); Yasushi Saito, Sagamihara (JP); Yu Ishiwata, Yasu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 12/645,926

(22) Filed: Dec. 23, 2009

(65) Prior Publication Data

US 2010/0090790 A1 Apr. 15, 2010

Related U.S. Application Data

(63) Continuation of application No. PCT/JP2008/059024, filed on May 16, 2008.

(30) Foreign Application Priority Data

Jul. 11, 2007 (JP) ..... 2007-181993

(51) Int. Cl.

| | |
|---|---|
| ***H01F 27/02*** | (2006.01) |
| ***H01F 27/29*** | (2006.01) |
| ***H01F 5/00*** | (2006.01) |
| ***H01F 27/28*** | (2006.01) |

(52) U.S. Cl. ..... 336/83; 336/192; 336/200; 336/223

(58) Field of Classification Search ..... None
See application file for complete search history.

(56) References Cited

U.S. PATENT DOCUMENTS

| | | | | |
|---|---|---|---|---|
| 3,593,217 | A * | 7/1971 | Weber | 333/175 |
| 6,154,112 | A * | 11/2000 | Aoba et al. | 336/192 |
| 6,373,366 | B1 * | 4/2002 | Sato et al. | 336/192 |
| 6,717,500 | B2 * | 4/2004 | Girbachi et al. | 336/83 |
| 6,965,289 | B2 * | 11/2005 | Toi et al. | 336/83 |
| 7,436,372 | B2 * | 10/2008 | Abe | 343/788 |
| 7,463,130 | B2 * | 12/2008 | Oki | 336/192 |
| 2002/0084878 | A1 * | 7/2002 | Kimura et al. | 336/83 |
| 2003/0030526 | A1 * | 2/2003 | Hirai et al. | 336/83 |
| 2003/0071704 | A1 | 4/2003 | Toi et al. | |
| 2006/0071749 | A1 * | 4/2006 | Aoki et al. | 336/83 |

(Continued)

FOREIGN PATENT DOCUMENTS

EP 0 997 917 A1 5/2000

(Continued)

OTHER PUBLICATIONS

Official Communication issued in International Patent Application No. PCT/JP2008/059024, mailed on Aug. 26, 2008.

*Primary Examiner* — Anh Mai
*Assistant Examiner* — Mangtin Lian
(74) *Attorney, Agent, or Firm* — Keating & Bennett, LLP

(57) ABSTRACT

A common-mode choke coil includes a core, external electrodes, a pair of wires, and a top plate. The core includes a winding core portion and a pair of flanges at both ends of the winding core portion. The upper surface of the winding core portion and the upper surfaces of the flanges are covered with a metal film. The external electrodes are provided on lower portions of the flanges. A pair of wires are wound on the winding core portion of the core, and the ends of the wires are connected to the external electrodes. The top plate is bonded to the upper surfaces of the flanges preferably via an adhesive.

7 Claims, 7 Drawing Sheets

U.S. PATENT DOCUMENTS

2009/0195342 A1 8/2009 Azuma et al.

FOREIGN PATENT DOCUMENTS

JP 8-186028 A 7/1996
JP 2000-133522 A 5/2000
JP 2001-93756 A 4/2001
JP 2003-168611 A 6/2003
JP 2006-73958 A 3/2006
JP 2007-142931 A 6/2007
WO 2008/065824 A1 6/2008

* cited by examiner

COMMON-MODE CHOKE COIL

BACKGROUND OF THE INVENTION

1. Field of the Invention

The present invention relates to a wire-wound common-mode choke coil which removes common-mode noise occurring on a transmission line.

2. Description of the Related Art

Common-mode choke coils, for example, are disclosed in Japanese Unexamined Patent Application Publication No. 2003-168611 and Japanese Unexamined Patent Application Publication No. 2000-133522.

The common-mode choke coil includes two wires wound on a winding core portion of a core having flanges at both ends, both ends of the wires being connected to electrodes on the flanges, and a ferrite plate arranged over the upper surfaces of the flanges.

This configuration is capable of removing common-mode noise entering a differential transmission line, for example.

However, the above-mentioned conventional common-mode choke coil has the following problems.

Usually, before products are put on the market, the products are subjected to an immunity test in which the products are exposed to electromagnetic interference to determine whether they resist various types of electromagnetic interference.

In the immunity test for common-mode noise of a common-mode choke coil, the common-mode choke coil is arranged in front of a receiving integrated circuit (IC) connected to a transmission IC through a differential transmission line. In addition, a differential signal is transmitted from the transmission IC to the receiving IC through the differential transmission line, and common noise is produced on the differential transmission line and superimposed on the differential signal. In this state, it is determined whether or not the transmission IC and the receiving IC cause a malfunction.

However, in this immunity test, the inductance of the common-mode choke coil and the input capacitance of the receiving IC define a resonant circuit, and the ratio of suppression of common-mode noise decreases at the resonance frequency of the resonant circuit and in a frequency band near the resonance frequency. In this case, a problem occurs in which the common-mode choke coil does not pass the immunity test due to a malfunction of the transmission IC and the receiving IC.

SUMMARY OF THE INVENTION

To overcome the problems described above, preferred embodiments of the present invention provide a common-mode choke coil that prevents malfunction of a transmission IC and a receiving IC in an immunity test, thereby improving the immunity property.

A common-mode choke coil according to a preferred embodiment of the present invention includes a magnetic core including a winding core portion and a pair of flanges provided at both ends of the winding core portion, an external electrode provided at each of the flanges, a pair of wires wound on the winding core portion, the ends thereof being led to the external electrodes and connected thereto, and a magnetic plate connected to the pair of flanges, wherein a metal film other than the external electrodes is provided on at least a connecting portion connected to the magnetic plate, the connecting portion being a portion of the magnetic core.

In this configuration, the metal film is provided on at least the connecting portion connected to the magnetic plate, the connecting portion being a portion of the magnetic core. Therefore, magnetic lines of force caused by currents in the pair of wires pass through the metal film, which produces eddy currents in the metal film. Therefore, a resistance component that is resistant to noise is increased by the metal film at the resonance frequency of a resonant circuit and in a frequency band near the resonance frequency, the resonant circuit being defined by the inductance of the common-mode choke coil and the capacitance of an input portion of a receiving IC in an immunity test, thereby suppressing common-mode noise. As a result, outstanding noise suppression is exhibited for noise in all frequency bands in the immunity test.

Preferably, the metal film extends continuously over the upper surfaces of the pair of flanges and the upper surface of the winding core portion, the upper surfaces of the flanges defining the connection portion.

Preferably each of the magnetic core and the magnetic plate is made of ferrite, for example.

This configuration provides improved magnetic properties of the common-mode choke coil.

Preferably, the metal film is made of a ferromagnetic material including at least one of iron, cobalt, nickel, chromium, manganese, and copper, for example.

This configuration further improves the resistance component that is resistant to noise while maintaining the superior magnetic properties.

Preferably, the metal film is made a ferromagnetic alloy including an alloy of nickel and chromium or an alloy of nickel and copper as a main component, for example.

Preferably, ends of the pair of wires are bonded to the external electrodes via an adhesive, and a magnetic powder is mixed in the adhesive.

This configuration further improves the magnetic properties of the common-mode choke coil.

As described above, in the common-mode choke coil of various preferred embodiments of the present invention, the metal film is provided on at least the connecting portion with the magnetic plate, the connecting portion being a portion of the magnetic core, and thus, the immunity property is improved. As a result, the common-mode choke coil effectively suppresses common-mode noise for noise in all frequency bands in the immunity test.

In addition, the common-mode choke coil according to various preferred embodiments of the present invention advantageously increases the resistance component to noise.

Further, various preferred embodiments of the present invention improve the magnetic properties of the coil.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Preferred embodiments of the present invention are described below with reference to the drawings.

Preferred Embodiment 1

Figure 1:
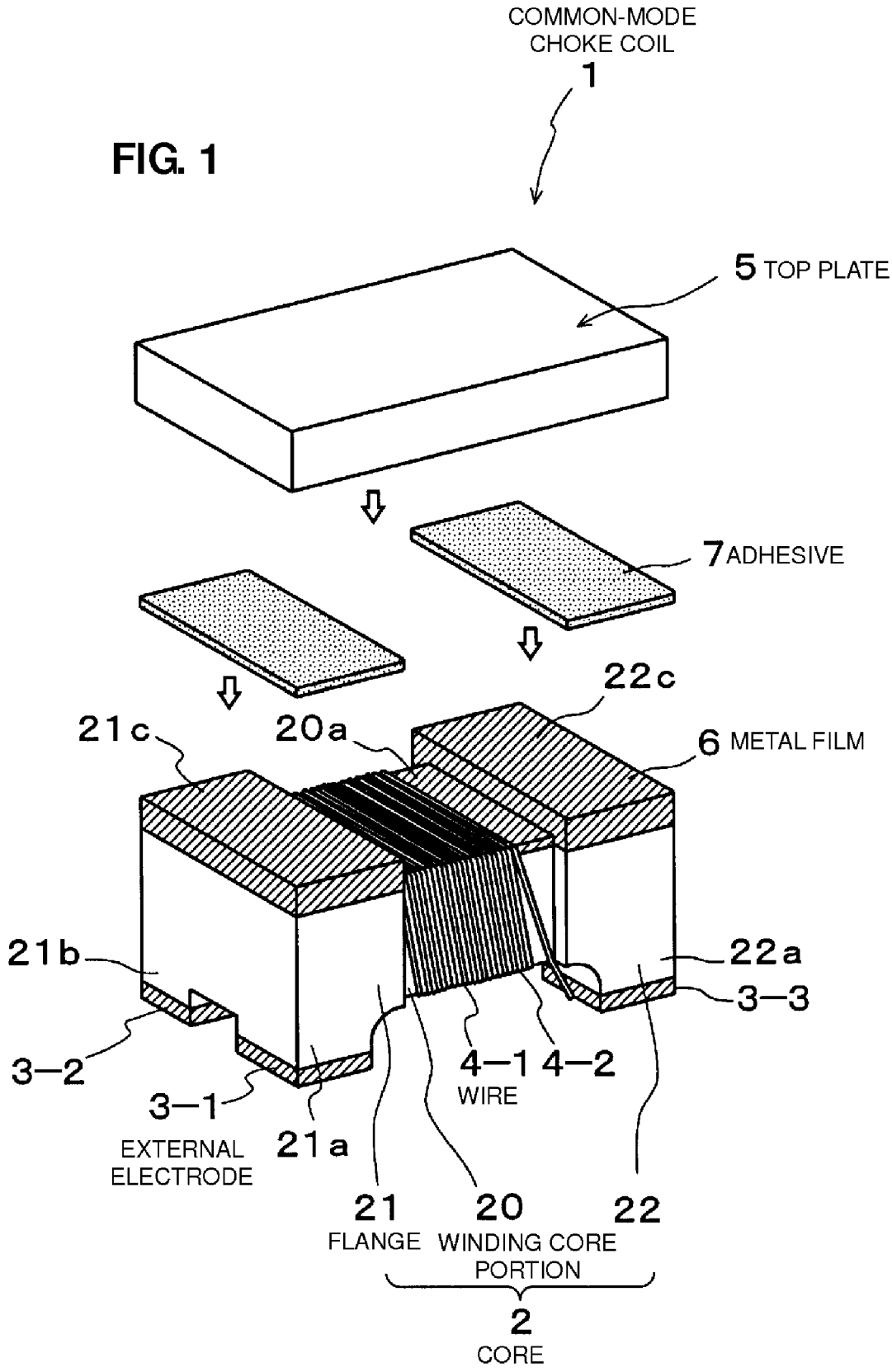
FIG. 1 is an exploded perspective view showing a principal portion of a common-mode choke coil according to a preferred embodiment of the present invention.
Figure 2:
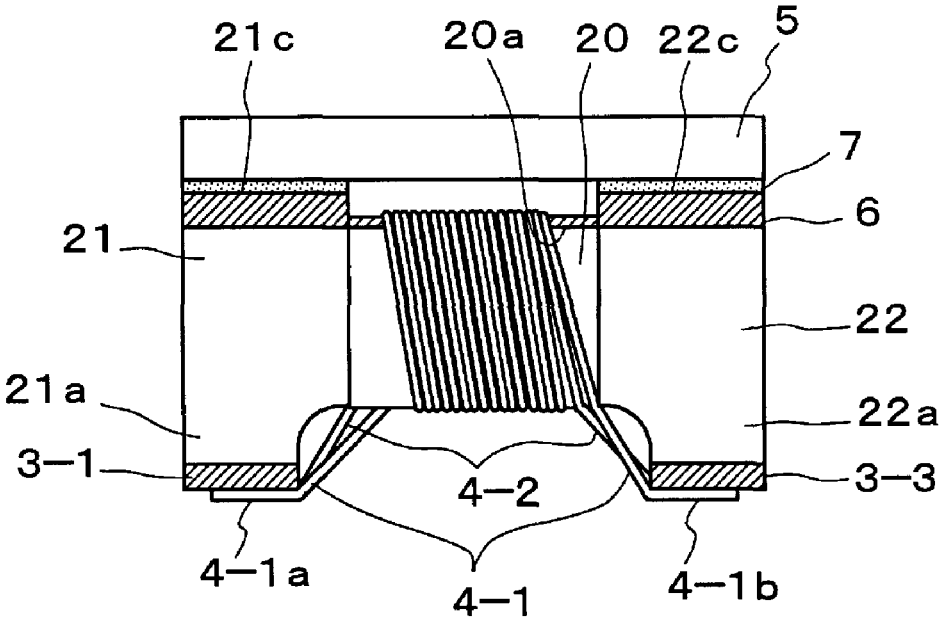
FIG. 2 is a front view of a common-mode choke coil of a preferred embodiment of the present invention.
Figure 3:
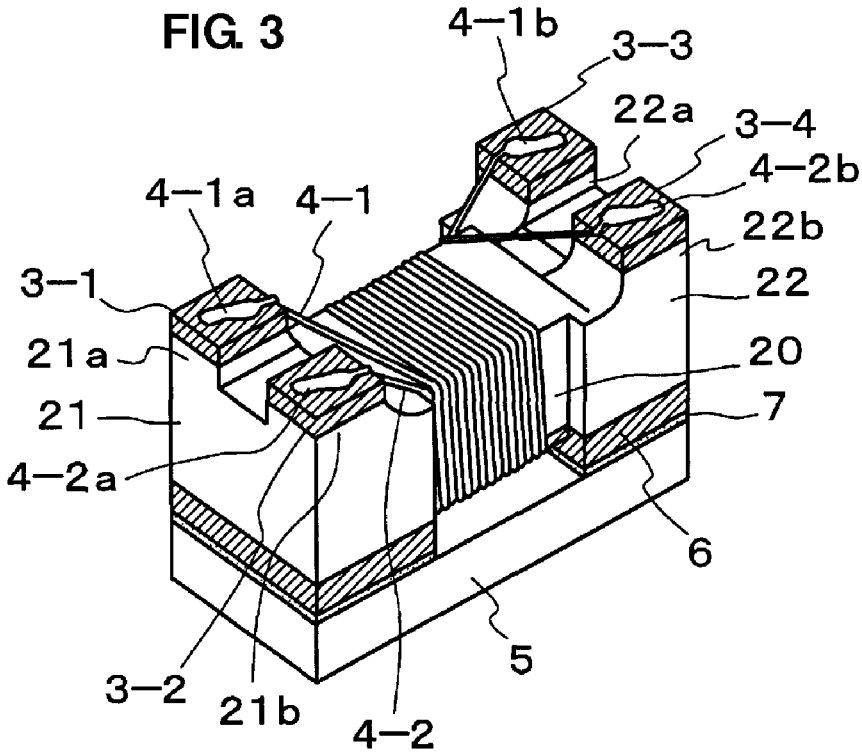
FIG. 3 is a perspective view showing the bottom of a common-mode choke coil of a preferred embodiment of the present invention.

FIG. 1 is an exploded perspective view showing a principal portion of a common-mode choke coil according to a preferred embodiment of the present invention, FIG. 2 is a front view of the common-mode choke coil of the present preferred embodiment, and FIG. 3 is a perspective view showing the bottom of the common-mode choke coil.

A common-mode choke coil 1 preferably is a surface mounting-type wire-wound coil, and as shown in FIGS. 1 and 2, is provided with a core 2 as a magnetic core, four external electrodes 3-1 to 3-4, a pair of wires 4-1 and 4-2, and a top plate 5 defining a magnetic plate.

The core 2 is preferably made of ferrite, such as Ni—Zn ferrite, for example, and includes a central winding core portion 20 and a pair of flanges 21 and 22 at both ends of the core portion 20. The upper surface 20*a* of the winding core portion 20 and the upper surfaces 21*c* and 22*c* of the flanges 21 and 22 are covered with a metal film 6.

Specifically, the metal film 6 is preferably made of a ferromagnetic material containing at least one of iron, cobalt, nickel, chromium, manganese, and copper, for example. However, the metal film is more preferably made of a ferromagnetic material including an alloy of nickel and chromium or an alloy of nickel and copper as a main component, for example. The thickness of the metal film 6 is preferably about 0.3 μm to about 5 μm, for example, and more preferably in a range of about 0.5 μm to about 3 μm, for example. The metal film 6 extends continuously over the upper surface 21*c* which is a connecting portion between the top plate 5 and the flange portion 21, the upper surface 20*a* of the winding core portion 20, and the upper surface 22*c* which is a connecting portion between the top plate 5 and the flange portion 22 so that the upper surfaces 20*a*, 21*c*, and 22*c* are entirely or substantially entirely covered with the metal film 6.

The external electrodes 3-1 to 3-4 are provided on the lower portions of the flanges 21 and 22.

Specifically, as shown in FIG. 3, the external electrodes 3-1 and 3-2 are provided on leg portions 21*a* and 21*b* of the flange 21, and the external electrodes 3-3 and 3-4 are provided on leg portions 22*a* and 22*b* of the flange 22.

Each of the pair of wires 4-1 and 4-2 is a line including a copper wire coated with an insulating film. The pair of wires 4-1 and 4-2 are wound on the metal film 6 of the winding core portion 20 of the core 2. In addition, the ends 4-1*a* and 4-2*a* of the wires 4-1 and 4-2 are extended to the external electrodes 3-1 and 3-2 and connected to the external electrodes 3-1 and 3-2, respectively, and the ends 4-1*b* and 4-2*b* of the wires 4-1 and 4-2 are extended to the external electrodes 3-3 and 3-4 and connected to the external electrodes 3-3 and 3-4, respectively.

The top plate 5 shown in FIG. 1 is preferably made of ferrite, such as Mn—Zn ferrite or Ni—Zn ferrite, for example. The top plate 5 is disposed over the upper surfaces 21*c* and 22*c* of the flanges 21 and 22 and is connected or bonded to the upper surfaces 21*c* and 22*c* preferably via an adhesive 7, for example.

In addition, magnetic powder may preferably be mixed in the adhesive 7, for example. Mixing of the magnetic powder permits not only bonding between the core 2 and the top plate 5 but also improved magnetic properties therebetween.

Next, the function of the metal film 6 will be described.

Figure 4:
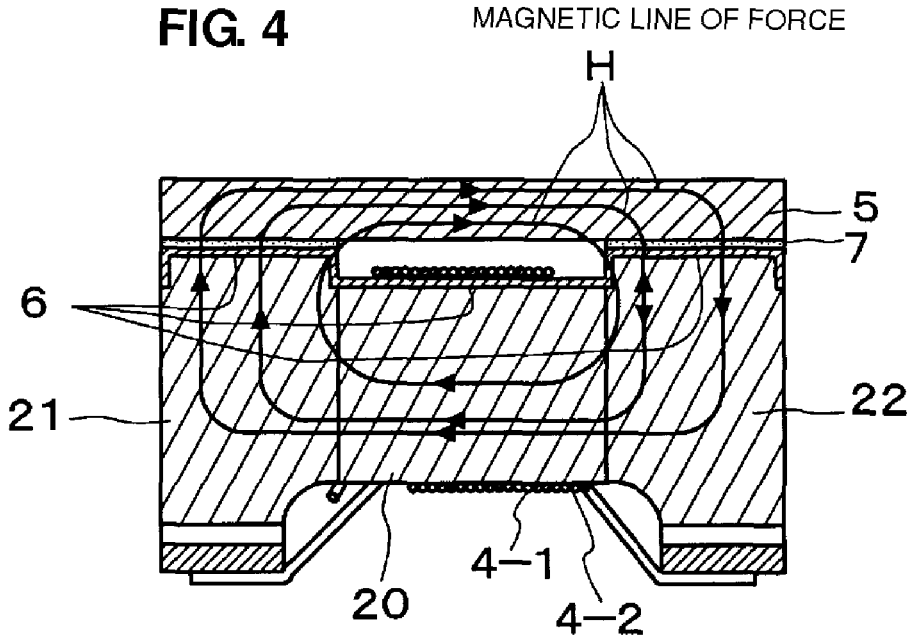
FIG. 4 is a sectional view of FIG. 2, explaining the function of a metal film.
Figure 5:
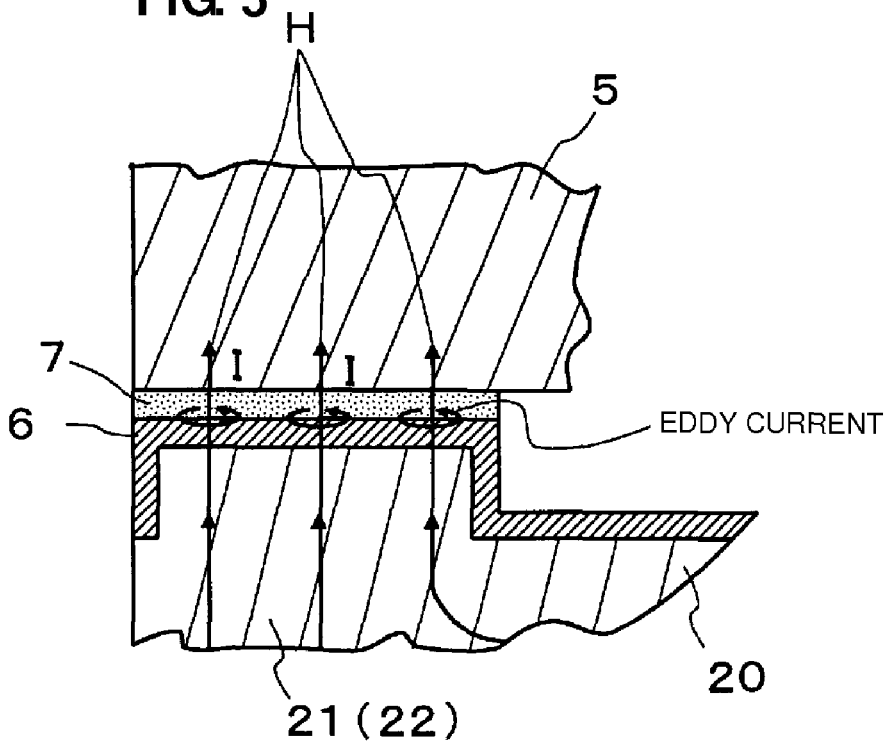
FIG. 5 is an enlarged partial sectional view showing eddy currents generated on a metal film.

FIG. 4 is a sectional view explaining the function of the metal film 6, and FIG. 5 is an enlarged partial sectional view showing eddy currents generated in the metal film 6.

In the common-mode choke coil 1 having the above-described configuration, when a signal at a predetermined frequency is input to the common-mode choke coil 1, magnetic lines H of force corresponding to the signal are produced along the winding core portion 20, the flanges 21 and 22, and the top plate 5 as shown by arrows in FIG. 4.

In this case, the metal film 6 is arranged in a portion in which the magnetic lines H of force pass through, and thus, the metal film 6 functions as a resistance component of the common-mode choke coil 1.

Specifically, as shown in FIG. 5, the magnetic lines H of force extending from the flange 21 (22) to the top plate 5 (or from the top plate 5 to the flange 21 (22)) pass through the metal film 6, and eddy currents I are produced on the surface of the metal film 6 due to the magnetic lines H of force. As a result, the energy of a signal flowing through the pair of wires 4-1 and 4-2 is consumed, and the metal film 6 functions as a resistance component to the signal flowing through the pair of wires 4-1 and 4-2.

Next, a method for manufacturing the common-mode choke coil 1 will be described.

FIGS. 6A to 6D are process drawings showing the method for manufacturing the common-mode choke coil 1.

Figure 6A:
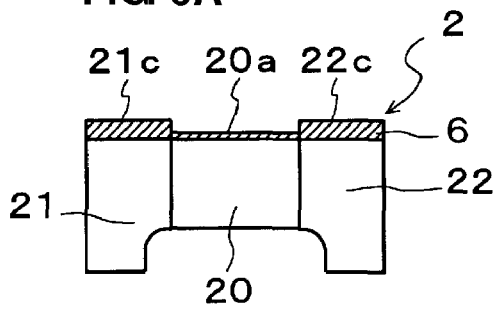
FIGS. 6A to 6D are process drawings showing a method for manufacturing a common-mode choke coil.
Figure 6B:
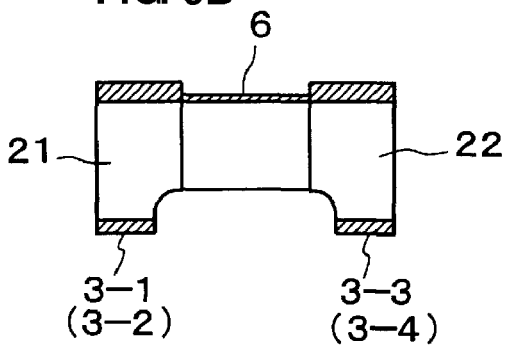
Figure 6C:
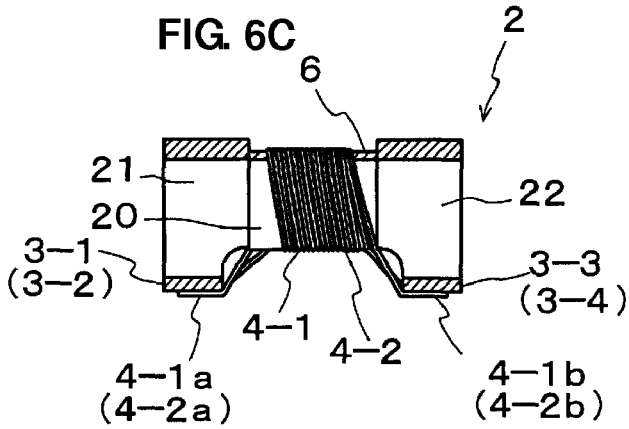
Figure 6D:
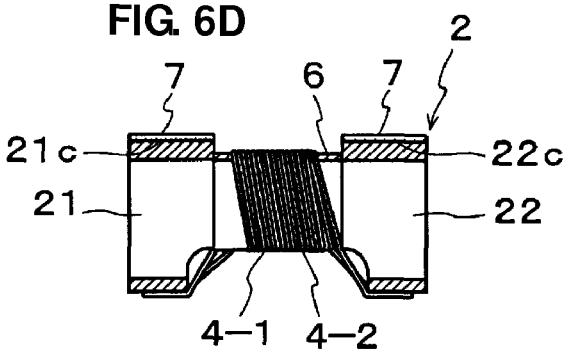

First, as shown in FIG. 6A, after the core 2 is formed, the metal film 6 is preferably formed over the upper surface 21*c* which is a connecting portion between the top plate 5 and the flange portion 21, the upper surface 20*a* of the winding core portion 20, and the upper surface 22*c* which is a connecting portion between the top plate 5 and the flange portion 22. Then, as shown in FIG. 6B, the external electrodes 3-1 to 3-4 are formed on the lower portions of the flanges 21 and 22 of the core 2. Then, as shown in FIG. 6C, the wires 4-1 and 4-2 are wound on the metal film 6 of the winding core portion 20 of the core 2. In addition, the ends 4-1*a* and 4-2*a* are connected to the external electrodes 3-1 and 3-2, respectively, and the ends 4-1*b* and 4-2*b* and connected to the external electrodes 3-3 and 3-4, respectively. Then, as shown in FIG. 6D, preferably the adhesive 7 is applied to the upper surfaces 21*c* and 22*c* of the flanges 21 and 22. Then, as shown in FIG. 2, the top plate 5 is bonded to the upper surfaces 21*c* and 22*c* of the core 2 with the adhesive 7 to produce the common-mode choke coil 1.

Next, the operation and advantages of the common-mode choke coil according to various preferred embodiments of the present invention will be described.

Figure 7:
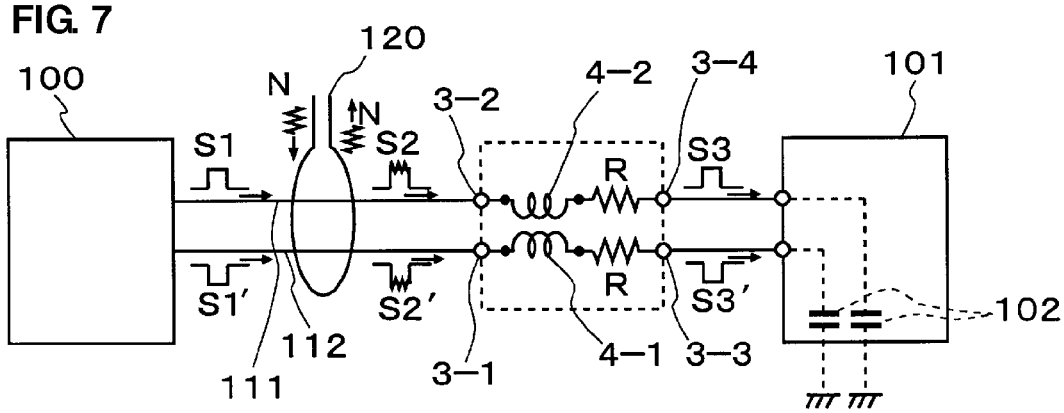
FIG. 7 is a schematic block diagram illustrating the operation and advantage of a common-mode choke coil according to a preferred embodiment of the present invention in an immunity test.

FIG. 7 is a schematic block diagram explaining the operation and advantages of the common-mode choke coil 1 in an immunity test.

In FIG. 7, reference numerals 100 and 101 denote a transmission IC and a receiving IC which are connected to each other through differential transmission lines 111 and 112. A noise generator 120 arranged to generate common-mode noise N is disposed in the differential transmission lines 111 and 112 on the transmission IC 100 side.

The common-mode choke coil 1 is preferably connected to a portion of the differential transmission lines 111 and 112 near the receiving IC 101 side. Specifically, the external electrodes 3-2 and 3-4 are connected to the differential transmission line 111, and the external electrodes 3-1 and 3-3 are connected to the differential transmission line 112.

In this state, differential signals S1 and S1' are output from the transmission IC 100 to the differential transmission lines 111 and 112, and common-mode noise N within a predetermined frequency range is generated on the differential transmission lines 111 and 112 using the noise generator 120.

As a result, differential signals S2 and S2' on which the common-mode noise N is superimposed are transmitted to the common-mode choke coil 1 side, and input to the common-mode choke coil 1 through the external electrodes 3-1 and 3-2. The differential signals S2 and S2' pass through the wires 4-1 and 4-2 and resistance components R and are output as differential signals S3 and S3' to the differential transmission lines 111 and 112 through the external electrodes 3-3 and 3-4.

In addition, the capacitance at the terminal of the receiving IC 101 is produced as a sum total of many capacitances produced at the terminal. In order to facilitate understanding, the capacitance is shown by capacitance 102. Since the capacitance 102 is present at the terminal of the receiving IC 101, the inductance of the wires 4-1 and 4-2 of the common-mode choke coil 1 and the capacitance 102 define a resonant circuit. The resonance frequency of the resonant circuit may be included in the frequency range of the common-mode noise N generated by the noise generator 102. In this state, the common-mode noise N at the resonance frequency and in the frequency band near the resonance frequency is not sufficiently suppressed, and the differential signals S3 and S3' on which the common-mode noise N is superimposed may be output.

However, in the common-mode choke coil 1 according to the preferred embodiment shown in FIGS. 1 and 2, the metal film 6 is arranged to cover the upper surface 20*a* of the winding core portion 20 and the upper surfaces 21*c* and 22*c* the flanges 21 and 22. In addition, as shown in FIGS. 4 and 5, the magnetic lines H of force pass through the metal film 6. Therefore, the occurrence of eddy currents I on the metal film 6 increases the resistance component R to common-mode noise N at the resonance frequency and in the frequency band near the resonance frequency, thereby suppressing the common-mode noise N by the resistance component R. As a result, an outstanding noise suppressing effect is provided for common-mode noise in all frequency bands in the immunity test.

In order to confirm the operation, advantages and effects, the inventors conducted the following experiment.

Figure 8:
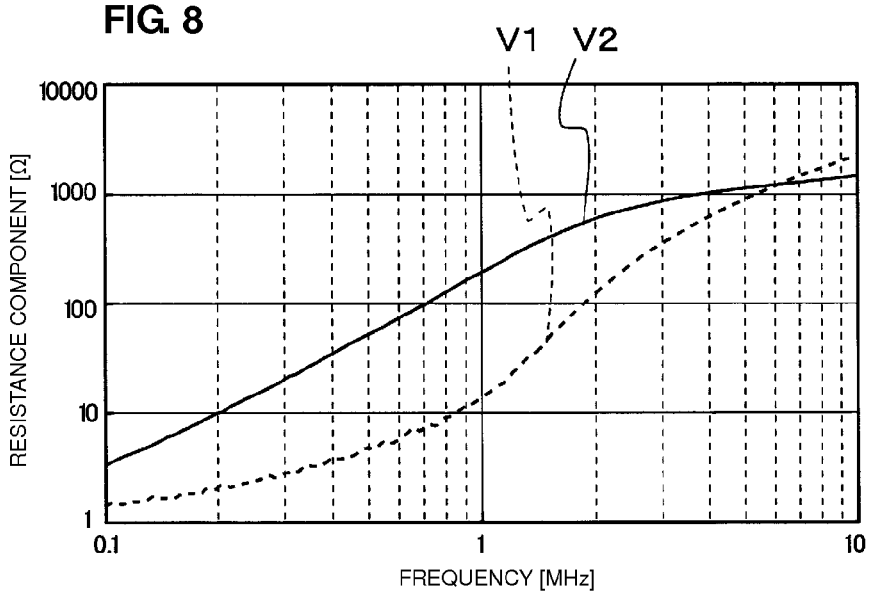
FIG. 8 is a diagram of the correlation between the frequency and resistance component measured in an experiment.
Figure 9A:
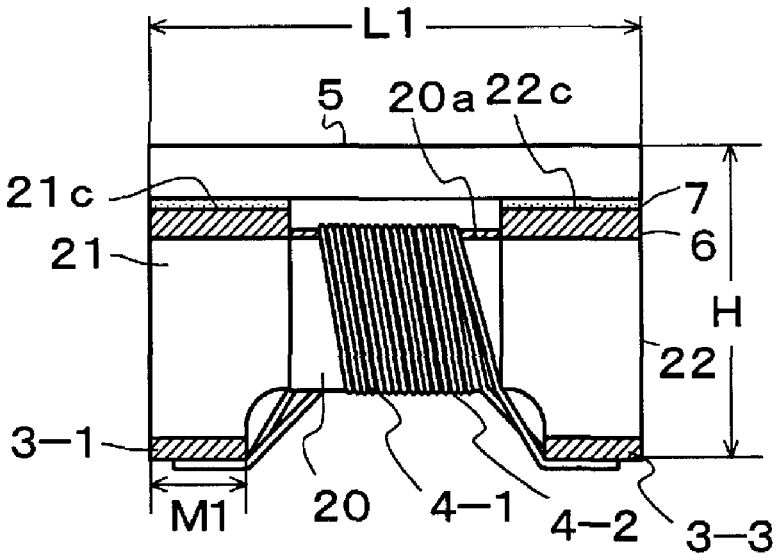
FIGS. 9A and 9B are diagrams illustrating the dimensions of a common-mode choke coil used in an experiment.
Figure 9B:
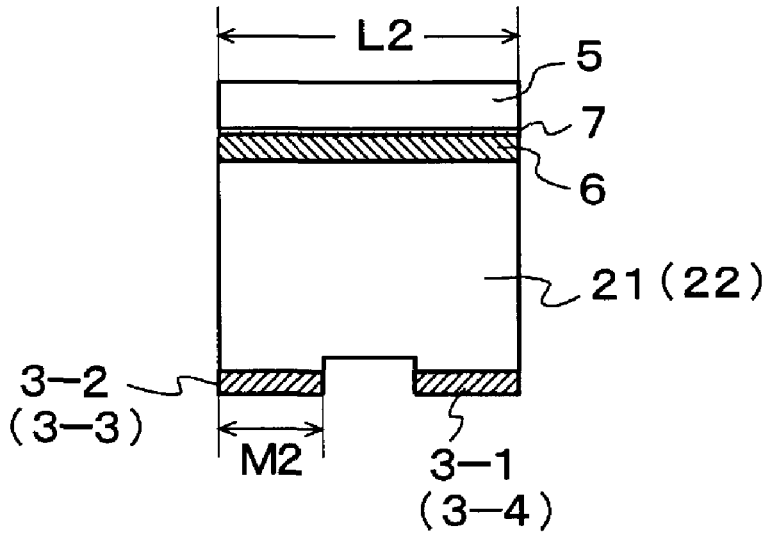

FIG. 8 is a diagram showing the correlation between the frequency and resistance component measured in an experiment, and FIGS. 9A and 9B are diagrams illustrating the dimensions of a common-mode choke coil used in the experiment.

In the experiment, in a common-mode choke coil that does not include the metal film 6, signals at about 0.1 MHz to about 10 MHz were input to measure the resistance component (Ω) of impedance at each frequency.

Specifically, as shown in FIGS. 9A and 9B, a common-mode choke coil was formed, in which within an error range of about ±0.2 mm, the length L1, width L2, and height H were about 4.5 mm, about 3.2 mm, and about 2.6 mm, respectively, the longitudinal length M1 and lateral length M2 of each external electrode 3-1 (3-2 to 3-4) were about 0.6 mm and about 0.8 mm, respectively, the number of turns of a pair of wires 4-1 and 4-2 was 15, and the inductance was about 100 μH. Then, signals at the above frequencies were input. The capacitance 102 was about 10 pF to about 20 pF.

As a result, as shown by a curve V1 shown by a broken line in FIG. 8, in the common-mode choke coil which does not include the metal film 6, a low resistance state of about 2Ω to about 1000Ω occurs in the frequency region of about 0.1 MHz to about 6 MHz.

Next, as shown in FIGS. 1 and 2, the metal film 6 was provided on the upper surface 20*a* of the winding core portion 20, the upper surfaces 21*c* and 22*c* and the peripheral side surface 5*c* of the flanges 21 and 22, and the same experiment as described above was performed. As a result, as shown by a curve V2 shown by a solid line in FIG. 8, the resistance component is significantly increased in the frequency region of about 0.1 MHz to about 6 MHz as compared to the resistance component of the common-mode choke coil which does not include the metal film 6.

Therefore, the inventors confirmed that a resistance component in a relatively low frequency region can be improved by providing the metal film 6.

The present invention is not limited to the above-described preferred embodiments, and various deviations and modifications can be made within the scope of the present invention.

Figure 10:
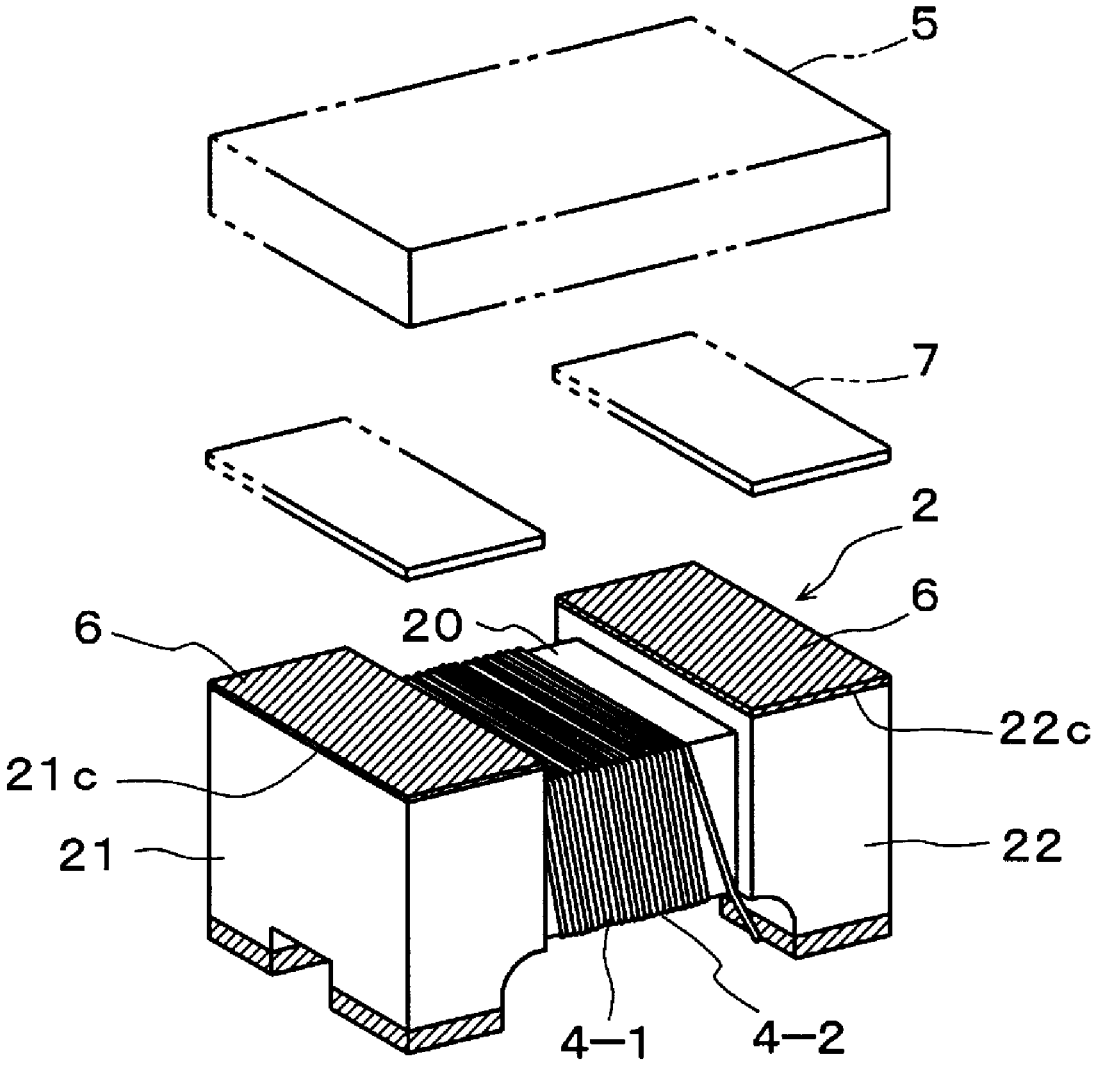
FIG. 10 is a perspective view showing a principal portion of a modified example of a preferred embodiment of the present invention.

For example, in the preferred embodiment shown in FIGS. 1 to 3, the metal film 6 is preferably arranged to cover the upper surface 20*a* of the winding core portion 20, and the upper surfaces 21*c* and 22*c* of the flanges 21 and 22. However, the metal film 6 may preferably be arranged on at least the connecting portion with the top plate 5 in the core 2. Therefore, as shown in FIG. 10, preferred embodiments of the present invention may preferably include a common-mode choke coil in which the metal film 6 may be provided only on the upper surfaces 21*c* and 22*c* of the flanges 21 and 22.

In addition, although, in the preferred embodiment shown in FIGS. 1 to 3, each of the core 2 and the top plate 5 is preferably made of ferrite, each of these members of the common-mode choke coil may preferably be made of a magnetic material other than ferrite.

Further, although, in the preferred embodiment shown in FIGS. 1 to 3, the external electrodes 3-1 to 3-4 preferably are directly applied on the flanges 21 and 22, another preferred embodiment of the present invention includes external electrodes that are formed on flanges 2 using metal terminals.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A common-mode choke coil comprising:

a magnetic core including a winding core portion and a pair of flanges provided at both ends of the winding core portion;

an external electrode provided at each of the pair of flanges;

a pair of wires wound on the winding core portion, ends of the pair of wires extending to the external electrodes and being connected thereto; and a magnetic plate connected to the pair of flanges; wherein a metal film is provided on at least a connecting portion that is connected to the magnetic plate, the connecting portion being a portion of the magnetic core; and the metal film is not electrically connected to the external electrodes provided at each of the pair of flanges.

2. The common-mode choke coil according to claim 1, wherein the metal film extends continuously over upper surfaces of the pair of flanges and an upper surface of the winding core portion, the upper surfaces of the flanges defining the connecting portion.

3. The common-mode choke coil according to claim 1, wherein each of the magnetic core and the magnetic plate is made of ferrite.

4. The common-mode choke coil according to claim 1, wherein the metal film is made of a ferromagnetic material including at least one of iron, cobalt, nickel, chromium, manganese, and copper.

5. The common-mode choke coil according to claim 4, wherein the metal film is made of a ferromagnetic alloy including an alloy of nickel and chromium or an alloy of nickel and copper as a main component.

6. The common-mode choke coil according to claim 1, wherein the magnetic plate is bonded to the pair of flanges via an adhesive.

7. The common-mode choke coil according to claim 6, wherein a magnetic powder is included in the adhesive.

* * * * *